US010793167B2

(12) United States Patent
Isomura et al.

(10) Patent No.: US 10,793,167 B2
(45) Date of Patent: Oct. 6, 2020

(54) RAILCAR BOGIE AND RAILCAR INCLUDING SAME

(71) Applicant: KAWASAKI JUKOGYO KABUSHIKI KAISHA, Kobe-shi, Hyogo (JP)

(72) Inventors: Kazuo Isomura, Kobe (JP); Takanori Tojo, Akashi (JP); Masahiro Sakahira, Akashi (JP); Satoshi Ikeda, Kobe (JP); Tomohide Maeba, Akashi (JP); Naoki Hikosaka, Kobe (JP); Tomohiro Narita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 395 days.

(21) Appl. No.: 15/577,107

(22) PCT Filed: May 24, 2016

(86) PCT No.: PCT/JP2016/002500
§ 371 (c)(1),
(2) Date: Nov. 27, 2017

(87) PCT Pub. No.: WO2016/189854
PCT Pub. Date: Dec. 1, 2016

(65) Prior Publication Data

US 2018/0201281 A1 Jul. 19, 2018

(30) Foreign Application Priority Data

May 25, 2015 (JP) ..... 2015-105486

(51) Int. Cl.
*B61F 5/16* (2006.01)

(52) U.S. Cl.
CPC ..... *B61F 5/16* (2013.01)

(58) Field of Classification Search
CPC ..... B61F 5/16
See application file for complete search history.

(56) References Cited

U.S. PATENT DOCUMENTS 2,934,028 A * 4/1960 Travilla ..... B61F 5/04 105/190.1
3,402,679 A * 9/1968 Christian ..... B61F 5/144 105/199.1
4,134,343 A * 1/1979 Jackson ..... B61F 5/38 105/167

FOREIGN PATENT DOCUMENTS

CN 102490753 A 6/2012
EP 2 783 939 A1 10/2014
(Continued)

OTHER PUBLICATIONS

Aug. 16, 2016 International Search Report issued in International Patent Application No. PCT/JP2016/002500.
(Continued)

*Primary Examiner* — Ryan A Reis
(74) *Attorney, Agent, or Firm* — Oliff PLC

(57) ABSTRACT

Invention includes bogie frame and single link type traction device coupling frame and carbody and transmitting force to carbody, force acting on bogie frame. Single link type traction device includes single link member, receiving seat, and first fastening member. Link member couples center pin of carbody and bogie frame and extends in car longitudinal direction. Receiving seat is provided at fixation target object constituted by center pin or bogie frame, and link member is fixed to receiving seat. First fastening member includes bolt and nut and fixes an end portion of link member to receiving seat. Bolt is inserted into end portion of link member and receiving seat from one side in car longitudinal direction, and nut is threadedly engaged with bolt from other side in car longitudinal direction. Receiving seat includes
(Continued)

through hole into which bolt is inserted and nut accommodating space communicating with through hole and accommodating nut.

7 Claims, 12 Drawing Sheets

(56) References Cited

FOREIGN PATENT DOCUMENTS

| | | | | |
|---|---|---|---|---|
| JP | H03-006539 | Y2 | | 2/1991 |
| JP | H11-78455 | A | | 3/1999 |
| JP | 2010-285071 | A | | 12/2010 |
| JP | 2010285071 | A | * | 12/2010 |
| JP | 2014066631 | A | * | 4/2014 |

OTHER PUBLICATIONS

Nov. 28, 2017 International Preliminary Report on Patentability issued in International Patent Application No. PCT/JP2016/002500.

* cited by examiner

RAILCAR BOGIE AND RAILCAR INCLUDING SAME

TECHNICAL FIELD

The present invention relates to a railcar bogie and a railcar including the railcar bogie.

BACKGROUND ART

A railcar bogie may be provided with a single link type traction device configured to transmit driving force of a bogie, braking force of a brake, and the like from the bogie to a carbody through a single traction link extending in a car longitudinal direction and coupling a center pin of the carbody and a bogie frame (see PTL 1, for example). In the single link type traction device, the center pin and the bogie frame are integrally provided with respective receiving seats to which respective car longitudinal direction end portions of the traction link are fixed. The traction link and each receiving seat are fixed to each other by a bolt. The receiving seat is provided with a screw hole including an inner peripheral surface having an internal thread threadedly engaged with an external thread of the bolt.

CITATION LIST

Patent Literature

PTL 1: Japanese Laid-Open Patent Application Publication No. 2010-285071

SUMMARY OF INVENTION

Technical Problem

However, since the screw hole needs to be accurately formed on the receiving seat by tapping performed by a worker, workability is low. Further, even when the screw hole is accurately formed on the receiving seat by the tapping, the screw hole may be damaged by mismanagement of tightening torque when tightening the bolt. In such case, the center pin provided integrally with the receiving seat or the entire bogie frame needs to be replaced, or large-scale repair work such as welding repair needs to be performed. Thus, another problem is that maintainability is low.

An object of the present invention is to provide a railcar bogie including a suitable single link type traction device capable of improving workability and maintainability.

Solution to Problem

A railcar bogie according to one aspect of the present invention includes: a bogie frame; and a single link type traction device coupling the bogie frame and a carbody and transmitting force to the carbody, the force acting on the bogie frame, wherein: the single link type traction device includes a single link member coupling a center pin of the carbody and the bogie frame and extending in a car longitudinal direction, a receiving seat provided at a fixation target object constituted by the center pin or the bogie frame, the link member being fixed to the receiving seat, and a first fastening member including a bolt and a nut and fixing an end portion of the link member to the receiving seat, the bolt being inserted into the end portion of the link member and the receiving seat from one side in the car longitudinal direction, the nut being threadedly engaged with the bolt from the other side in the car longitudinal direction; and the receiving seat includes a through hole into which the bolt is inserted and a nut accommodating space communicating with the through hole and accommodating the nut.

According to the above configuration, the through hole into which the bolt is inserted is formed on the receiving seat, and the nut is threadedly engaged with the bolt. With this, the end portion of the link member and the receiving seat are fixed to each other. Thus, a screw hole threadedly engaged with the bolt does not have to be formed on the receiving seat by tapping, and this can improve workability. Further, even if the screw hole is damaged by mismanagement of torque when fastening the bolt and the nut, the nut including the screw hole just has to be replaced. Therefore, it is unnecessary to replace the center pin or the entire bogie frame, perform large-scale repair work, and the like, and this can improve the maintainability.

Advantageous Effects of Invention

The present invention can provide a railcar bogie including a suitable single link type traction device capable of improving workability and maintainability.

DESCRIPTION OF EMBODIMENTS

Figure 1:
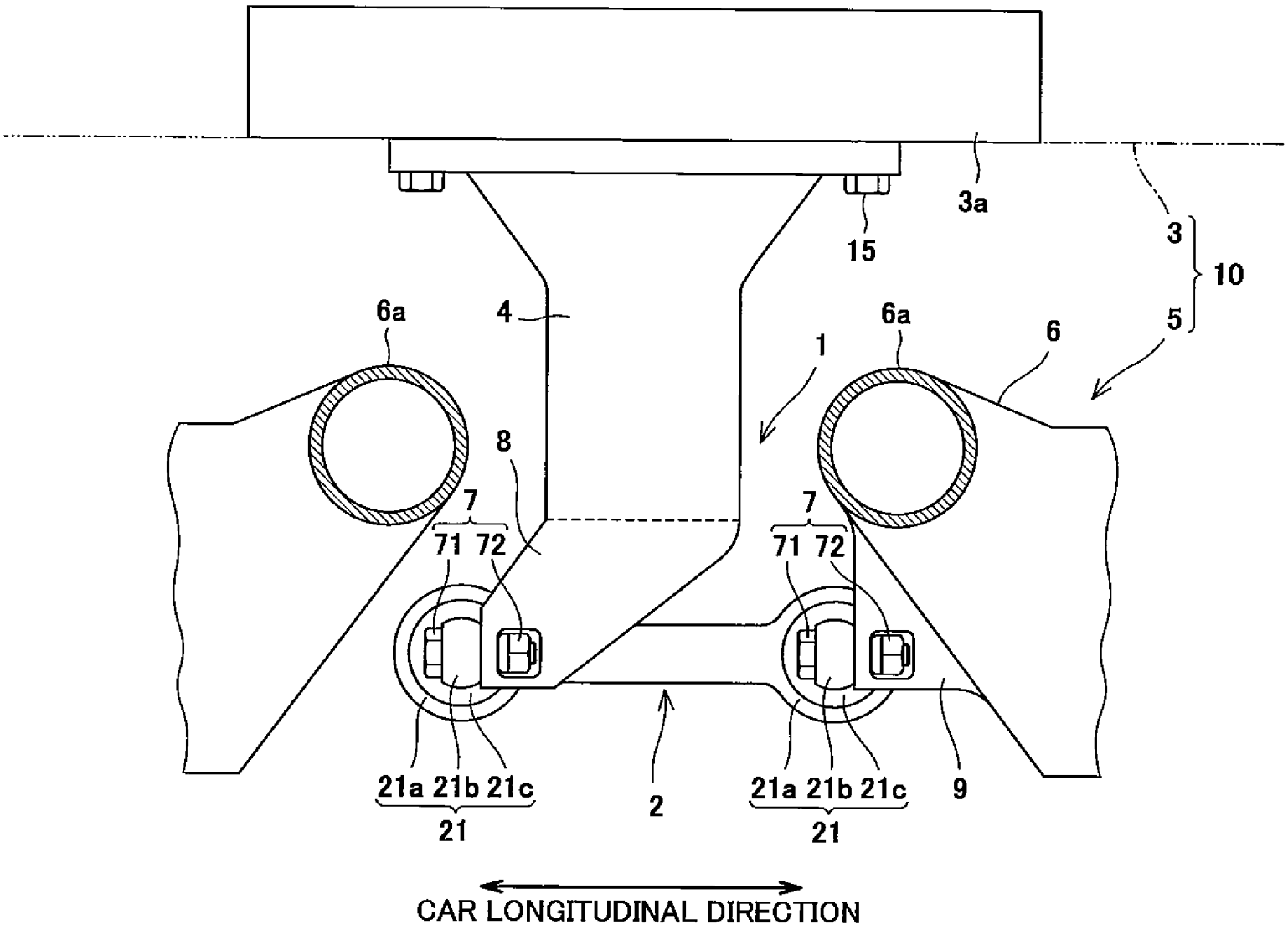
FIG. 1 is a side view showing a single link type traction device of a railcar including a railcar bogie according to Embodiment 1 and a vicinity of the single link type traction device.

Hereinafter, embodiments will be explained in reference to the drawings. In the drawings, the same reference signs are used for the same or corresponding components, and a repetition of the same detailed explanation is avoided.

Embodiment 1

FIG. 1 is a side view showing a single link type traction device 1 of a railcar 10 including a railcar the bogie 5 according to the present embodiment and a vicinity of the single link type traction device 1. As shown in FIG. 1, the railcar 10 includes a carbody 3 and the railcar bogie 5 (hereinafter referred to as "bogie 5") supporting the carbody 3. A center pin 4 is fixed to a lower surface of a bolster beam 3*a* of the carbody 3 by bolts 15. The bogie 5 is a so-called bolsterless bogie not including a bolster beam. The carbody 3 is coupled to a bogie frame 6 through the single link type traction device 1 of the bogie 5.

The single link type traction device 1 includes a single link member 2 extending in a car longitudinal direction. The link member 2 couples the center pin 4 and the bogie frame 6 to each other. The bogie frame 6 includes cross beams 6*a* each extending in a car width direction. Motors (not shown) are fixed to the respective cross beams 6*a*, and driving force of the motors is transmitted to wheels of the bogie 5 through reducers and the like to drive the bogie 5. Further, brake equipment (not shown) is fixed to the bogie 5 through an attaching seat. Force, such as driving force of the bogie 5 or braking force of a brake, acting on the bogie frame 6 is transmitted from the cross beams 6*a* of the bogie frame 6 through the link member 2 to the center pin 4.

The link member 2 includes pivot portions 21 at both car longitudinal direction ends thereof, the respective pivot portions 21 being fixed to the center pin 4 and the bogie frame 6. The pivot portions 21 are opposed to the respective cross beams 6*a* in an upward/downward direction. Each of the pivot portions 21 includes a cylindrical portion 21*a*, a core rod 21*b*, and a rubber bushing 21*c*. The cylindrical portion 21*a* is open at both car width direction sides thereof, and the core rod 21*b* is inserted into the cylindrical portion 21*a* through the rubber bushing 21*c*.

The core rod 21*b* projects from the openings at both car width direction sides of the cylindrical portion 21*a*. Both car width direction end portions of the core rod 21*b* are fixed to the center pin 4 or the bogie frame 6. To be specific, in the present embodiment, the center pin 4 and the bogie frame 6 are fixation target objects to which the link member 2 is fixed. Then, the core rods 21*b* of the pivot portions 21 corresponding to the car longitudinal direction end portions of the link member 2 are fixed to the respective fixation target objects.

The center pin 4 and the bogie frame 6 as the fixation target objects are provided with respective receiving seats 8 and 9 fixed to the respective core rods 21*b* of the link member 2. The receiving seats 8 and 9 are metal members. The receiving seat 8 is joined to a lower surface of the center pin 4 by welding to be integrated with the center pin 4. The receiving seat 9 is joined to a lower surface of the cross beam 6*a* of the bogie frame 6 by welding to be integrated with the bogie frame 6. The receiving seat 9 is formed integrally with a motor casing (not shown) accommodating the motor of the bogie 5. The receiving seats 8 and 9 are fixed to the respective core rods 21*b* of the link member 2 by respective first fastening members 7.

Hereinafter, a fixing structure for fixing the receiving seat 9 and the core rod 21*b* of the link member 2 by the first fastening member 7 will be explained in reference to FIGS. 2 to 5. Since a fixing structure for fixing the receiving seat 8 provided at the center pin 4 and the core rod 21*b* of the link member 2 is the same as the fixing structure for fixing the receiving seat 9 and the core rod 21*b* of the link member 2, an explanation thereof is omitted.

Figure 2:
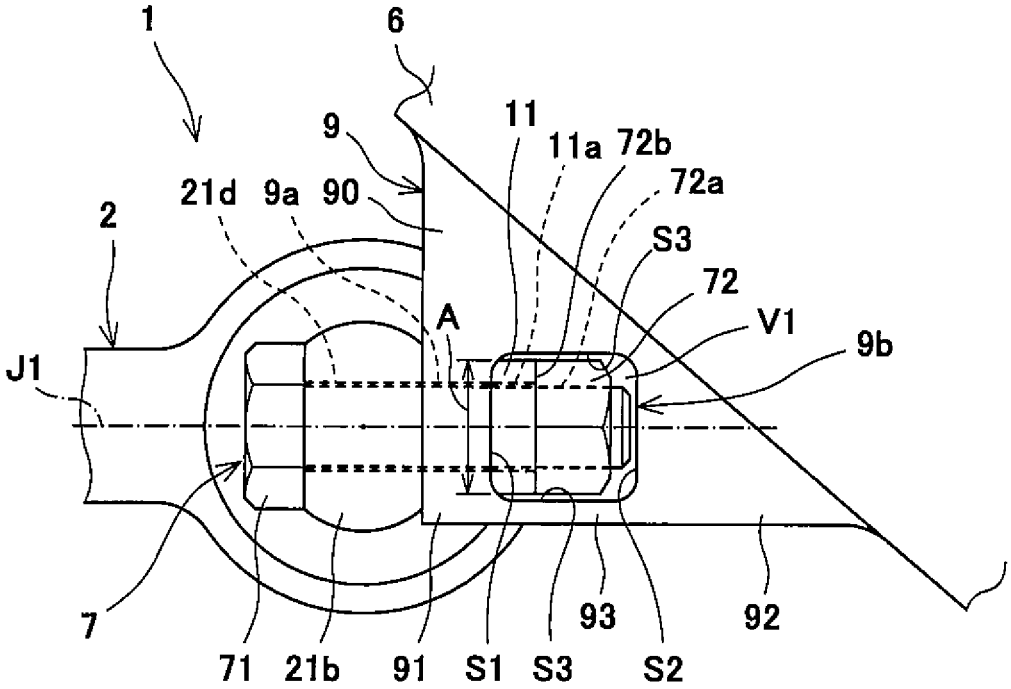
FIG. 2 is a diagram showing a receiving seat provided at a bogie frame of FIG. 1 and a vicinity of the receiving seat.

FIG. 2 is a diagram showing the receiving seat 9 provided at the bogie frame 6 of FIG. 1 and a vicinity of the receiving seat 9. As shown in FIG. 2, the first fastening member 7 includes a bolt 71 and a nut 72. The bolt 71 is inserted into the core rod 21*b* and the receiving seat 9 from one side in the car longitudinal direction. The nut 72 is threadedly engaged with the bolt 71 from the other side in the car longitudinal direction. The core rod 21*b* and the receiving seat 9 include respective through holes 21*d* and 9*a* into which the bolt 71 is inserted. The nut 72 includes a screw hole 72*a* including an inner peripheral surface having an internal thread threadedly engaged with an external thread of the bolt 71. In the present embodiment, the bolt 71 is a hexagon headed bolt including a head portion having a hexagonal outer shape, and the nut 72 is a hexagon nut having a hexagonal outer shape (see FIG. 4).

Figure 3:
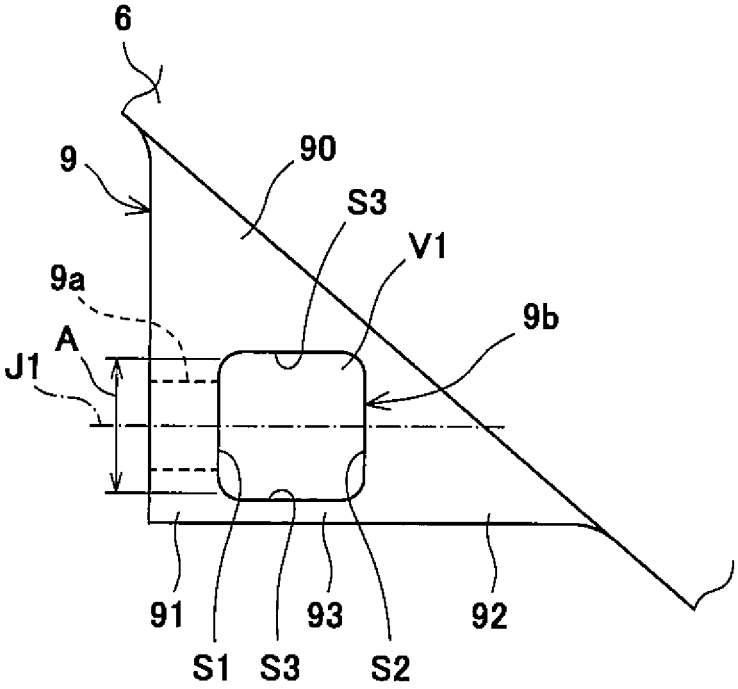
FIG. 3 is a diagram prepared by extracting only the receiving seat from FIG. 2.
Figure 4:
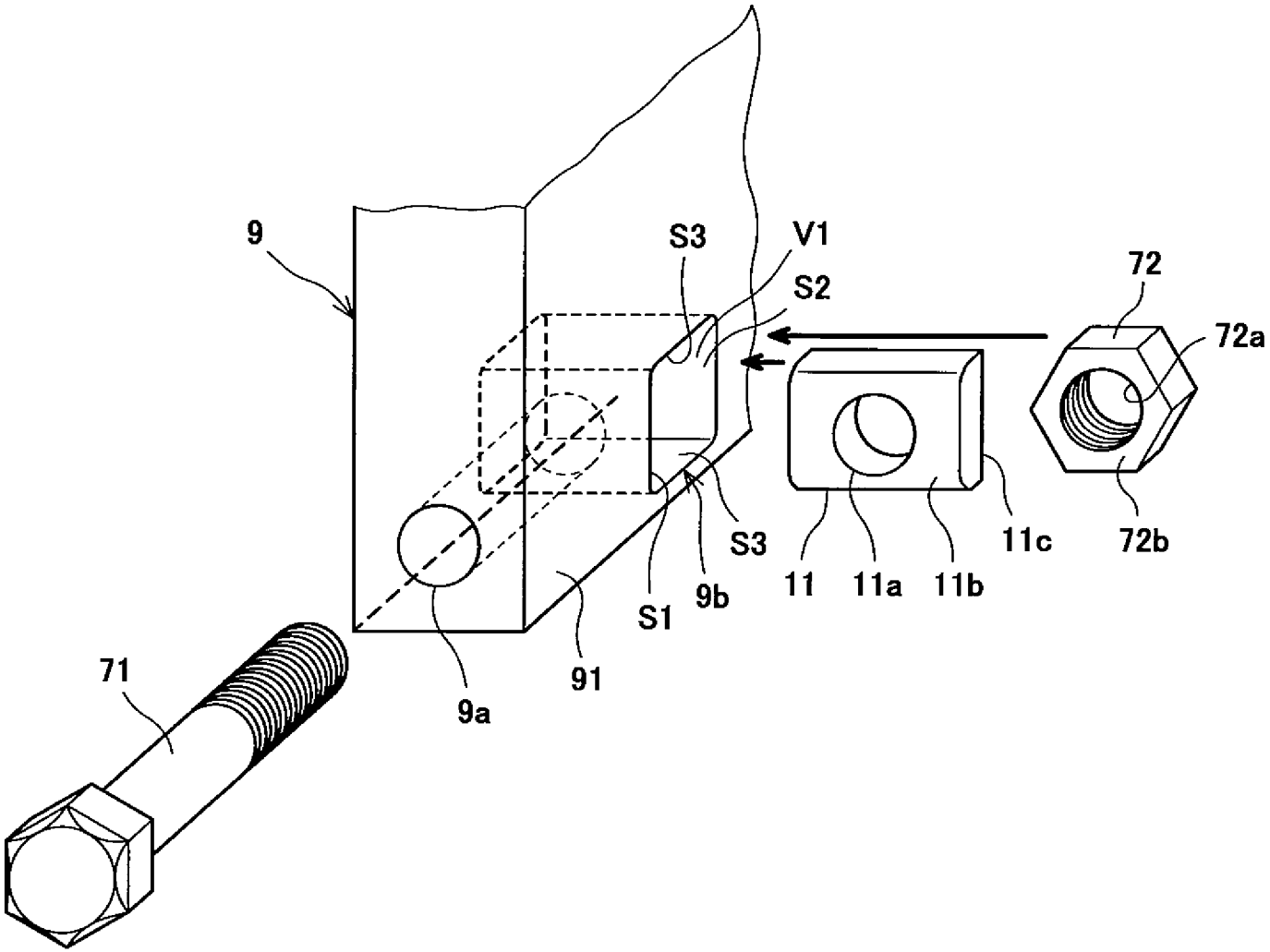
FIG. 4 is a perspective view showing a state where a fastening member and a spacer are detached from the receiving seat of FIG. 2.
Figure 5:
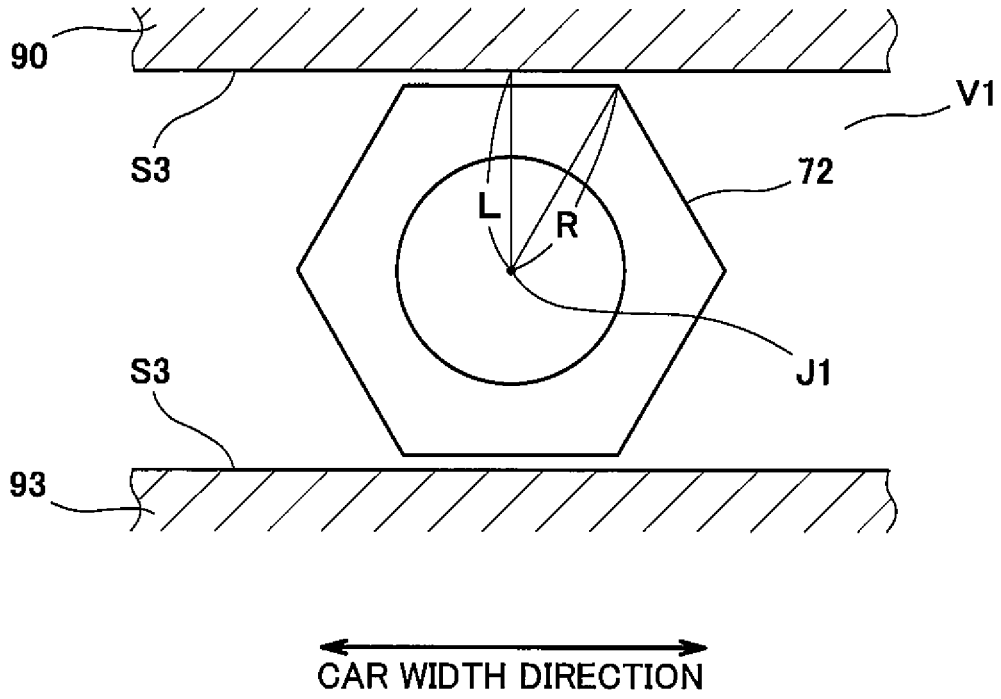
FIG. 5 is a diagram showing a state where a nut of FIG. 2 is accommodated in a nut accommodating space of the receiving seat.

FIG. 3 is a diagram prepared by extracting only the receiving seat 9 from FIG. 2. FIG. 4 is a perspective view showing a state where the first fastening member 7 and a spacer 11 are detached from the receiving seat 9 of FIG. 2. FIG. 5 is a front view showing a state where the nut 72 of FIG. 2 is accommodated in a nut accommodating space V1 of the receiving seat 9. For ease of explanation, the link member 2 is not shown in FIG. 4. As shown in FIGS. 2 to 5, the receiving seat 9 includes the nut accommodating space V1 accommodating the nut 72. In the present embodiment, the nut accommodating space V1 is an internal space of a polygonal hole 9*b* penetrating the receiving seat 9 in the car width direction. Further, in the present embodiment, the polygonal hole 9*b* is a polygonal hole having a substantially square shape in a side view.

The nut accommodating space V1 communicates with an internal space of the through hole 9*a* into which the bolt 71 is inserted. The nut accommodating space V1 is formed by first and second surfaces S1 and S2 opposed to the nut 72 in the car longitudinal direction (axial direction of the bolt 71) and a third surface S3 opposed to the nut 72 in a direction perpendicular to an axis J1 of the bolt 71. In the present embodiment, the third surface S3 includes surfaces located at both respective upward/downward direction sides of the nut 72 so as to be spaced apart from the nut 72. A shortest distance L between the third surface S3 and the axis J1 of the bolt 71 is smaller than a maximum radius R of the nut 72 when viewed from a direction along the axis J1 (see FIG. 5).

The polygonal hole 9*b* is formed by a cutting operation using an end mill as a tool. The end mill has a substantially cylindrical shape, and a plurality of blades are provided at a tip end portion of the end mill in a circumferential direction. For example, the end mill is moved relative to the receiving seat 9 in each of the car width direction and the car longitudinal direction by a predetermined distance while being rotated around an axis extending in the car width direction. With this, the polygonal hole 9*b* penetrating the receiving seat 9 in the car width direction is formed. A trajectory of an outer shape of the end mill at the time of the cutting operation has a circular-arc shape. Therefore, each of four corner portions of the polygonal hole 9*b* has a circular-arc surface.

In the present embodiment, each of the corner portions of the polygonal hole 9*b* is formed by the first and third surfaces S1 and S3 or the second and third surfaces S2 and S3. In the nut accommodating space V1, an opposing region A that is a part of the first surface S1 and is opposed to a fastening surface 72*b* of the nut 72 includes: a flat surface portion parallel to the fastening surface 72*b* of the nut 72 when viewed from the car width direction; and circular-arc surface portions located at both respective upper and lower sides of the flat surface portion and nonparallel to the fastening surface 72*b* of the nut 72. Therefore, the opposing region A of the first surface S1 is different in shape from the fastening surface 72*b* of the nut 72.

The spacer 11 that is a metal member is accommodated in the nut accommodating space V1. The spacer 11 is sandwiched between the first surface S1 and the fastening surface 72*b* of the nut 72. The spacer 11 includes a first through hole 11*a* into which the bolt 71 is inserted. A surface 11*b*, facing the first surface S1, of the spacer 11 is the same in shape as the opposing region A of the first surface S1, i.e., has a shape including circular-arc surface portions located at both respective upper and lower sides of a flat surface portion. A surface 11*c*, facing the fastening surface 72*b*, of the spacer 11 is the same in shape as the fastening surface 72*b*, i.e., has a planar shape.

When fixing the core rod 21*b* of the link member 2 to the receiving seat 9, the spacer 11 and the nut 72 are accommodated in the nut accommodating space V1, and in this state, the bolt 71 is inserted into the core rod 21*b*, the receiving seat 9, and the spacer 11 from one side in the car longitudinal direction. Then, by rotating the bolt 71 around the axis J1, the internal thread of the screw hole 72*a* formed on the nut 72 is fastened to the external thread of the bolt 71. Thus, the core rod 21*b* of the link member 2 and the receiving seat 9 are fixed to each other. As above, when the nut 72 is threadedly engaged with the bolt 71, the surface 11*b*, facing the first surface S1, of the spacer 11 is in surface contact with the opposing region A of the first surface S1, and the surface lie, facing the fastening surface 72*b*, of the spacer 11 is in surface contact with the fastening surface 72*b* of the nut 72.

Further, as shown in FIGS. 2 and 3, the receiving seat 9 includes a base portion 90, a first projecting portion 91, a second projecting portion 92, and a coupling portion 93. In the receiving seat 9, the base portion 90 is a portion located at an upper side of the nut accommodating space V1 and joined by welding to the bogie frame 6 that is the fixation target object. The base portion 90 includes the third surface S3 that is one of the surfaces forming the nut accommodating space V1 and is located above the nut 72. The first projecting portion 91 projects downward from one car longitudinal direction side of the base portion 90. The first projecting portion 91 includes the first surface S1 that is one of the surfaces forming the nut accommodating space V1 and is located at one car longitudinal direction side of the nut 72. A projecting end of the first projecting portion 91 extends downward beyond the nut accommodating space V1. Further, the through hole 9*a* into which the bolt 71 is inserted is formed on the first projecting portion 91.

The second projecting portion 92 projects downward from the other car longitudinal direction side of the base portion 90. The second projecting portion 92 projects so as to overlap the first projecting portion 91 when viewed from one side in the car longitudinal direction. Further, the second projecting portion 92 includes the second surface S2 that is one of the surfaces forming the nut accommodating space V1 and is located at the other car longitudinal direction side of the nut 72. By the coupling portion 93 extending in the car longitudinal direction, the first projecting portion 91 and the second projecting portion 92 are coupled to each other at a side where the projecting end of the first projecting portion 91 exists when viewed from the axis J1 of the bolt 71. The coupling portion 93 includes the third surface S3 that is one of the surfaces forming the nut accommodating space V1 and is located under the nut 72.

The single link type traction device 1 of the railcar 10 configured as above has the following effects.

The through hole 9*a* into which the bolt 71 is inserted is formed on the receiving seat 9, and the nut 72 is threadedly engaged with the bolt 71. With this, the core rod 21*b* of the link member 2 and the receiving seat 9 are fixed to each other. Thus, a screw hole threadedly engaged with the bolt 71 does not have to be formed on the receiving seat 9 by tapping, and this can improve workability. Further, even if the screw hole is damaged by mismanagement of torque when fastening the bolt 71 and the nut 72, the nut 72 including the screw hole just has to be replaced. Therefore, unlike a case where the screw hole is formed on the receiving seat by tapping, it is unnecessary to replace the entire bogie frame 6 with which the receiving seat 9 is integrated, and this can improve maintainability.

In the traction device 1, the driving force of the bogie 5, the braking force, and the like are transmitted from the bogie 5 to the carbody 3 by the single link member 2, so that loads acting on the receiving seats 8 and 9 fixed to the link member 2 are large. Therefore, the strength of the receiving seats 8 and 9 needs to be secured. Further, if the link member 2 is fixed to the receiving seat 9 by the bolt 71 and the nut 72 to improve the workability and the maintainability, and only the first projecting portion projects from the base portion joined to the bogie frame 6 that is the fixation target object, the first projecting portion is supported in a state of a cantilever beam. In this case, if the driving force, the braking force of the brake, or the like is transmitted from the bogie to the carbody, a load in the car longitudinal direction acts on the first projecting portion, and this generates high stress. Therefore, to secure the strength of the first projecting portion, the receiving seat needs to be increased in size. However, since the single link type traction device supports the load only by the single link, the link itself becomes large, and a space for the receiving seat that has to be increased in size is limited.

In the present embodiment, the first projecting portion 91 and the second projecting portion 92 are coupled to each other by the coupling portion 93 at a side where the projecting end of the first projecting portion 91 exists when viewed from the axis J1 of the bolt 71. With this, a base end of the first projecting portion 91 is supported by the base portion 90, and the projecting end of the first projecting portion 91 is supported by the second projecting portion 92 through the coupling portion 93. Therefore, the first projecting portion 91 is prevented from being supported in the state of the cantilever beam. On this account, the load acting on the first projecting portion 91 is transmitted through the coupling portion 93 to the second projecting portion 92. Thus, the generation of the high stress is prevented, and the strength of the entire receiving seat 9 can be secured.

Further, the nut 72 is accommodated in the nut accommodating space V1 such that the shortest distance L between the third surface S3 of the receiving seat 9 and the axis J1 of the bolt 71 is smaller than the maximum radius R of the nut 72. With this, even when the nut 72 rotates around the axis J1, the third surface S3 of the receiving seat 9 exists as an obstruction wall on a rotation trajectory of the nut 72, the rotation trajectory having a turning radius equal to the maximum radius R. Therefore, when fastening the bolt 71 and the nut 72, the nut 72 contacts the third surface S3 of the receiving seat 9, and thus, the nut 72 can be prevented from rotating together with the bolt 71.

The nut accommodating space V1 is constituted by the internal space of the polygonal hole 9*b*. Since each of the corner portions of the polygonal hole 9*b* has a circular-arc surface by the cutting operation, the first surface S1 forming the nut accommodating space V1 has a shape including the circular-arc surfaces, and the opposing region A, facing the fastening surface 72*b* of the nut 72, of the first surface S1 is different in shape from the fastening surface 72*b* having the planar shape. In this case, when the bolt 71 and the nut 72 are fastened to each other, the nut 72 is in point contact with the first surface S1, and a gap is formed between the fastening surface 72*b* and the first surface S1. Therefore, fastening power is not adequately applied to a portion where the core rod 21*b* of the link member 2 and the receiving seat 9 are fixed to each other, so that the core rod 21*b* of the link member 2 and the receiving seat 9 cannot be strongly fixed to each other.

However, in the present embodiment, the spacer 11 is sandwiched between the first surface S1 and the fastening surface 72*b* of the nut 72, and the spacer 11 includes the surfaces 11*b* and 11*c* which are respectively the same in shape as the opposing region A, facing the fastening surface 72*b*, of the first surface S1 and the fastening surface 72*b*. Therefore, when fastening the bolt 71 and the nut 72, the surface 11*b*, facing the first surface S, of the spacer 11 and the first surface S1 are in surface contact with each other, and the surface 11*c*, facing the fastening surface 72*b*, of the spacer 11 and the fastening surface 72*b* are in surface contact with each other. On this account, the core rod 21*b* of the link member 2 and the receiving seat 9 can be strongly fixed to each other.

Embodiment 2

A single link type traction device 200 of a railcar bogie according to Embodiment 2 is obtained by partially modifying the receiving seat 9 according to Embodiment 1. Hereinafter, differences between a receiving seat 209 according to Embodiment 2 and the receiving seat 9 according to Embodiment 1 will be mainly explained.

Figure 6:
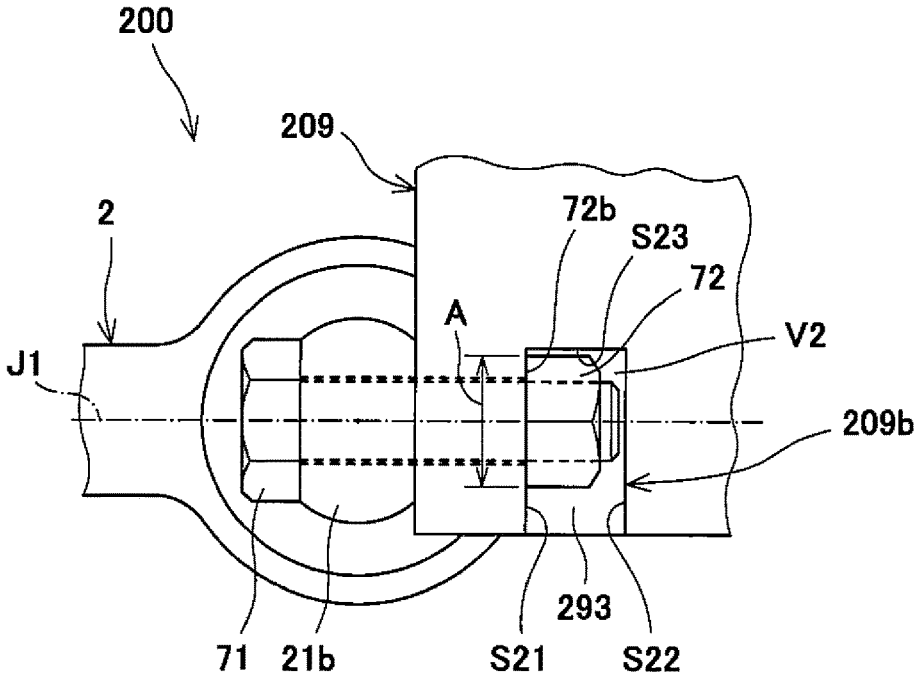
FIG. 6 is a diagram showing the single link type traction device of the railcar bogie according to Embodiment 2 and corresponding to FIG. 2.
Figure 7:
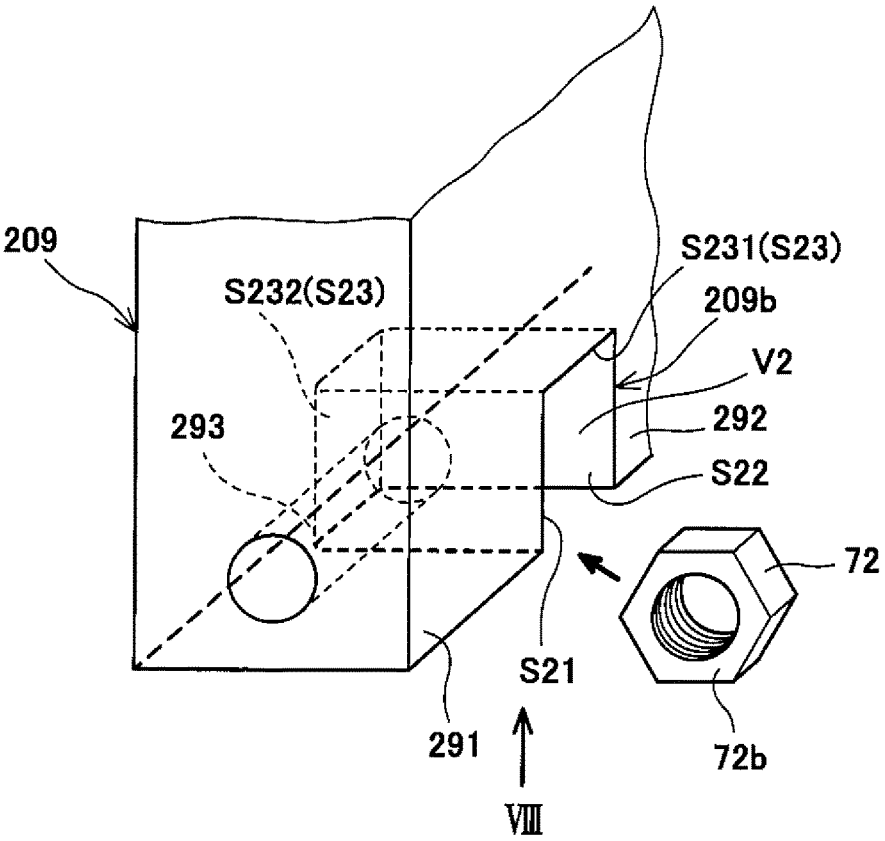
FIG. 7 is a diagram showing the single link type traction device of the railcar bogie according to Embodiment 2 and corresponding to FIG. 4.
Figure 8:
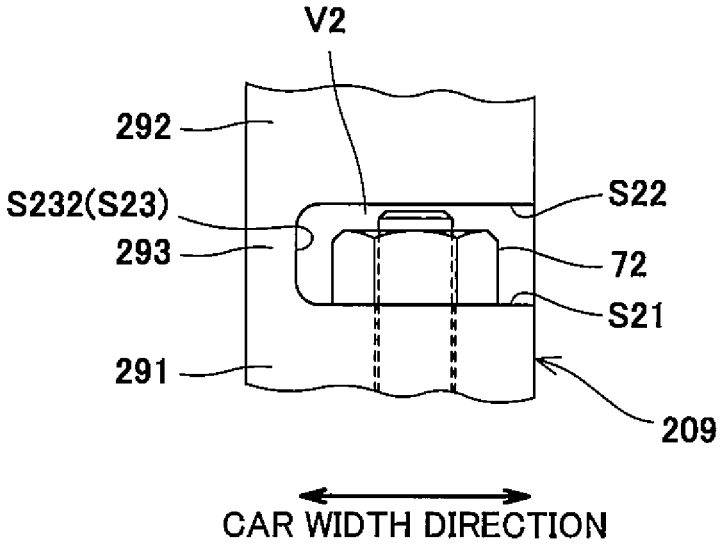
FIG. 8 is a diagram when viewed from a direction VIII shown in FIG. 7.

FIG. 6 is a diagram showing the single link type traction device 200 of the railcar bogie according to the present embodiment and corresponding to FIG. 2. FIG. 7 is a diagram showing the single link type traction device 200 of the railcar bogie according to Embodiment 2 and corresponding to FIG. 4. FIG. 8 is a diagram when viewed from a direction VIII shown in FIG. 7. As shown in FIGS. 6 to 8, the receiving seat 209 includes a cutout 209*b* formed by partially opening one car width direction side surface and lower surface of the receiving seat 209. A nut accommodating space V2 is a space surrounded by surfaces constituting the cutout 209*b*. In the present embodiment, a third surface S23 forming the nut accommodating space V2 includes: a surface S231 located above the nut 72; and a surface S232 located at the other car width direction side of the nut 72.

For example, the cutout 209*b* is formed by a cutting operation using an end mill. For example, the end mill is moved relative to the lower surface of the receiving seat 209 in each of the car width direction and the car longitudinal direction by a predetermined distance while being rotated around an axis extending in the upward/downward direction. With this, the surfaces constituting the cutout 209*b* are formed. In the cutout 209*b*, each of a portion where the first surface S21 and the third surface S232 intersect with each other and a portion where the second surface S22 and the third surface S232 intersect with each other has a circular-arc surface by a trajectory of an outer shape of the end mill at the time of the cutting operation.

In the nut accommodating space V2, the nut 72 is accommodated at a position away from corner portions of the cutout 209*b* toward one side in the car width direction so as not to contact the corner portions when the nut 72 is fastened to the bolt 71. With this, the opposing region A, facing the fastening surface 72*b* of the nut 72, of the first surface S1 has the same planar shape as the fastening surface 72*b* of the nut 72. Further, the nut 72 is accommodated in the nut accommodating space V2 such that a shortest distance between the third surface S231 of the receiving seat 209 and the axis J1 of the bolt 71 is smaller than the maximum radius R of the nut 72 when viewed from a direction along the axis J1.

Further, in the receiving seat 209 in the present embodiment, a first projecting portion 291 and a second projecting portion 292 project downward from the base portion 90. A projecting end of the first projecting portion 291 and a projecting end of the second projecting portion 292 extend to reach the lower surface of the receiving seat 209. Further, since the cutout 209*b* is formed by the cutting operation so as not to penetrate the receiving seat 209 in the car width direction, a side wall exists between the third surface S3 forming the nut accommodating space V2 and the other car width direction side surface of the receiving seat 209. In this side wall, a coupling portion 293 is a portion which couples the first projecting portion 291 and the second projecting portion 292 at a side where the projecting end of the first projecting portion 291 exists when viewed from the axis J1 of the bolt 71. Other than the above, Embodiment 2 is the same in configuration as Embodiment 1.

Embodiment 2 described as above can obtain the same effects as Embodiment 1. Further, in Embodiment 2, the opposing region A, facing the fastening surface 72*b* of the nut 72, of the first surface S1 is the same in shape as the fastening surface 72*b* of the nut 72. Therefore, when fastening the bolt 71 and the nut 72, the fastening surface 72*b* can be brought into surface contact with the first surface S21 without using the spacer 11. Thus, the number of parts can be reduced.

The shortest distance between the third surface S231 of the receiving seat 209 and the axis J1 of the bolt 71 is smaller than the maximum radius R of the nut 72. Therefore, even when the nut 72 rotates around the axis J1, the third surface S231 of the receiving seat 209 exists as an obstruction wall on a rotation trajectory of the nut 72, the rotation trajectory having a turning radius equal to the maximum radius R. On this account, when fastening the bolt 71 and the nut 72, the nut 72 contacts the third surface S231 of the receiving seat 209, and thus, the nut 72 can be prevented from rotating together with the bolt 71.

It should be noted that the nut 72 may be accommodated in the nut accommodating space V2 such that a shortest distance between the third surface S232 of the receiving seat 209 and the axis J1 of the bolt 71 is smaller than the maximum radius R of the nut 72. In this case, the opposing region A, facing the fastening surface 72*b* of the nut 72, of the first surface S21 is different in shape from the fastening surface 72*b*, so that a spacer having surfaces that are respectively the same in shape as the opposing region A of the first surface S21 and the fastening surface 72*b* is only required to be sandwiched between the first surface S21 and the fastening surface 72*b*.

Embodiment 3

A single link type traction device 300 of a railcar bogie according to Embodiment 3 is obtained by partially modifying the receiving seat 9 according to Embodiment 1. Hereinafter, differences between a receiving seat 309 according to Embodiment 3 and the receiving seat 9 according to Embodiment 1 will be mainly explained.

Figure 9:
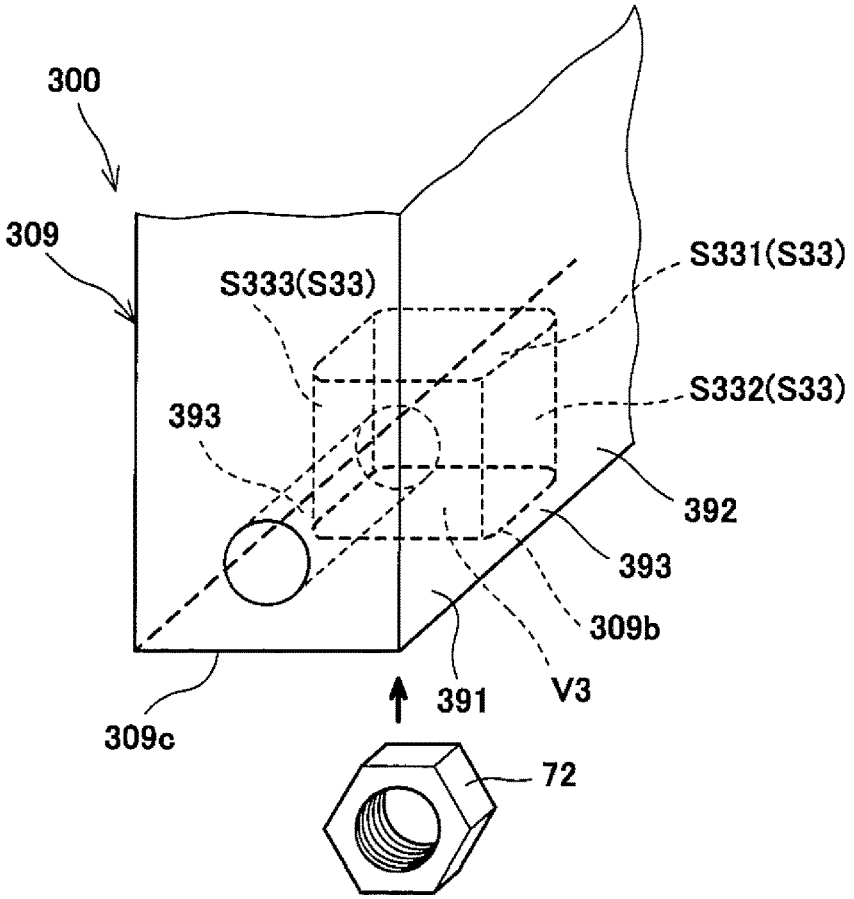
FIG. 9 is a diagram showing the single link type traction device of the railcar bogie according to Embodiment 3 and corresponding to FIG. 4.
Figure 10:
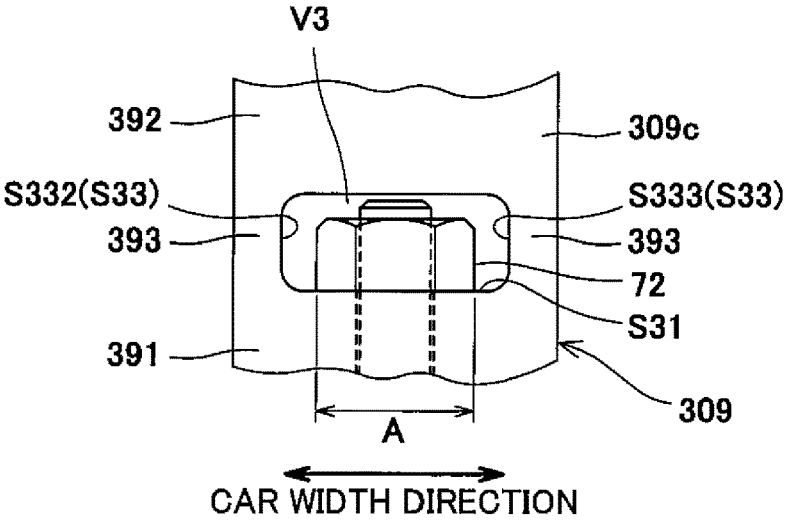
FIG. 10 is a diagram showing the single link type traction device of the railcar bogie according to Embodiment 3 and corresponding to FIG. 8.

FIG. 9 is a diagram showing the single link type traction device 300 of the railcar bogie according to the present embodiment and corresponding to FIG. 4. FIG. 10 is a diagram showing the single link type traction device 300 of the railcar bogie according to the present embodiment and corresponding to FIG. 8. As shown in FIGS. 9 and 10, the receiving seat 309 includes a polygonal hole 309*b* formed by partially opening a lower surface of the receiving seat 309. The polygonal hole 309*b* has a square shape when viewed from the upward/downward direction. A nut accommodating space V3 is an internal space of the polygonal hole 309*b* and is concavely provided on a lower surface 309*c* of the receiving seat 309.

In the present embodiment, a third surface S33 forming the nut accommodating space V3 includes: a surface S331 located above the nut 72; and surfaces S332 and S333 located at both respective car width direction sides of the nut 72. When forming the polygonal hole 309*b* by the cutting operation, each of corner portions of the polygonal hole 309*b* is formed to have a circular-arc surface by a trajectory of an outer shape of the end mill at the time of the cutting operation.

In the present embodiment, the nut 72 is accommodated in the nut accommodating space V3 so as not to contact the corner portions of the polygonal hole 309*b* when the nut 72 is fastened to the bolt 71. With this, the opposing region A, facing the fastening surface 72*b* of the nut 72, of the first surface S31 has the same planar shape as the fastening surface 72*b* of the nut 72. Further, the nut 72 is accommodated in the nut accommodating space V3 such that a shortest distance between the third surface S331 of the receiving seat 309 and the axis J1 of the bolt 71 is smaller than the maximum radius R of the nut 72 when viewed from a direction along the axis J1.

Further, in the receiving seat 309, a first projecting portion 391 and a second projecting portion 392 project downward from the base portion 90. A projecting end of the first projecting portion 391 and a projecting end of the second projecting portion 392 extend to reach the lower surface of the receiving seat 309. Furthermore, in the receiving seat 309, a side wall exists between the third surface S332 and one car width direction side surface of the receiving seat 309, and a side wall exists between the third surface S333 and the other car width direction side surface of the receiving seat 309. In these side walls, coupling portions 393 are portions each of which couples the first projecting portion 391 and the second projecting portion 392 at a side where the projecting end of the first projecting portion 391 exists when viewed from the axis J1 of the bolt 71. The coupling portions 393 are wall portions located at both respective car width direction sides of the nut 72 and forming the nut accommodating space V3. Other than the above, Embodiment 3 is the same in configuration as Embodiment 1.

Embodiment 3 described as above can obtain the same effects as Embodiment 1. Further, in Embodiment 3, the receiving seat 309 includes the coupling portions 393 at both respective car width direction sides of the nut 72. Therefore, unlike a case where a coupling portion is provided at only one car width direction side of a nut, a load acting on the first projecting portion 391 of the receiving seat 309 is dispersed to a plurality of coupling portions 393 to be transmitted to the second projecting portion 392. Therefore, the load is prevented from concentrating on one coupling portion, and the strength of the entire receiving seat 309 is more easily secured.

Further, the nut accommodating space V3 is concavely provided on the lower surface 309*c* of the receiving seat 309, and the coupling portions 393 are the wall portions located at both respective car width direction sides of the nut 72 and forming the nut accommodating space V3. With this, even when a load in the car longitudinal direction acts on the receiving seat 309, the generation of the high stress can be suppressed at a portion of the receiving seat 309 where a section perpendicular to the car longitudinal direction changes, unlike a case where the nut accommodating space penetrates the receiving seat in the car width direction. Thus, the strength of the entire receiving seat 309 can be secured.

The shortest distance between the third surface S331 of the receiving seat 309 and the axis J1 of the bolt 71 is smaller than the maximum radius R of the nut 72. Therefore, even when the nut 72 rotates around the axis J1, the third surface S331 of the receiving seat 309 exists as an obstruction wall on a rotation trajectory of the nut 72, the rotation trajectory having a turning radius equal to the maximum radius R. On this account, when fastening the bolt 71 and the nut 72, the nut 72 contacts the third surface S331 of the receiving seat 309, and thus, the nut 72 can be prevented from rotating together with the bolt 71.

It should be noted that the nut 72 may be accommodated in the nut accommodating space V3 such that a shortest distance between the third surface S332 or S333 of the receiving seat 309 and the axis J1 of the bolt 71 is smaller than the maximum radius R of the nut 72. In this case, the opposing region A, facing the fastening surface 72*b* of the nut 72, of the first surface S31 is different in shape from the fastening surface 72*b*, so that a spacer having surfaces that are respectively the same in shape as the opposing region A of the first surface S31 and the fastening surface 72*b* is only required to be sandwiched between the first surface S31 and the fastening surface 72*b*.

Embodiment 4

A single link type traction device 400 of a railcar bogie according to Embodiment 4 is obtained by partially modifying the receiving seat 9 and the nut 72 according to Embodiment 1. Hereinafter, differences between a receiving seat 409 and a nut 472 according to Embodiment 4 and the receiving seat 9 and the nut 72 according to Embodiment 1 will be mainly explained.

Figure 11:
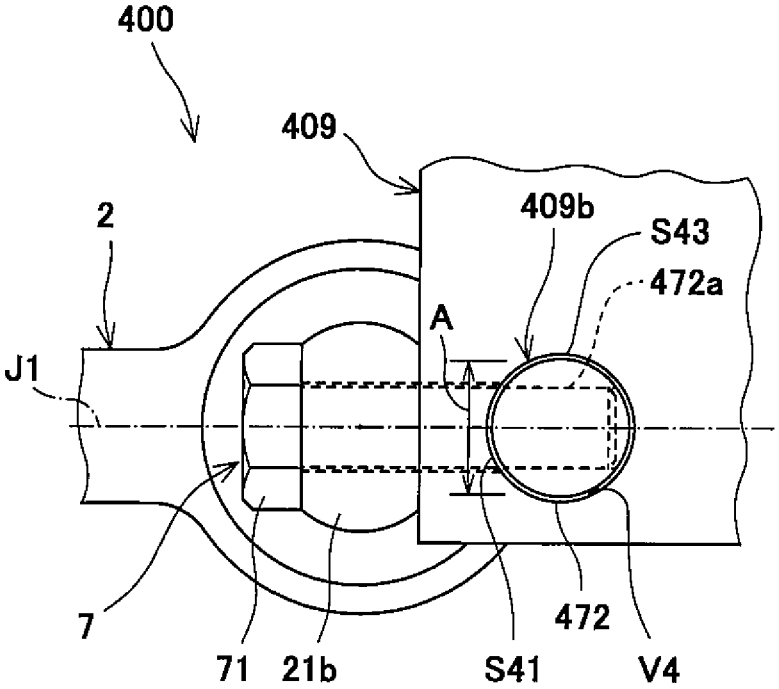
FIG. 11 is a diagram showing the single link type traction device of the railcar bogie according to Embodiment 4 and corresponding to FIG. 2.
Figure 12:
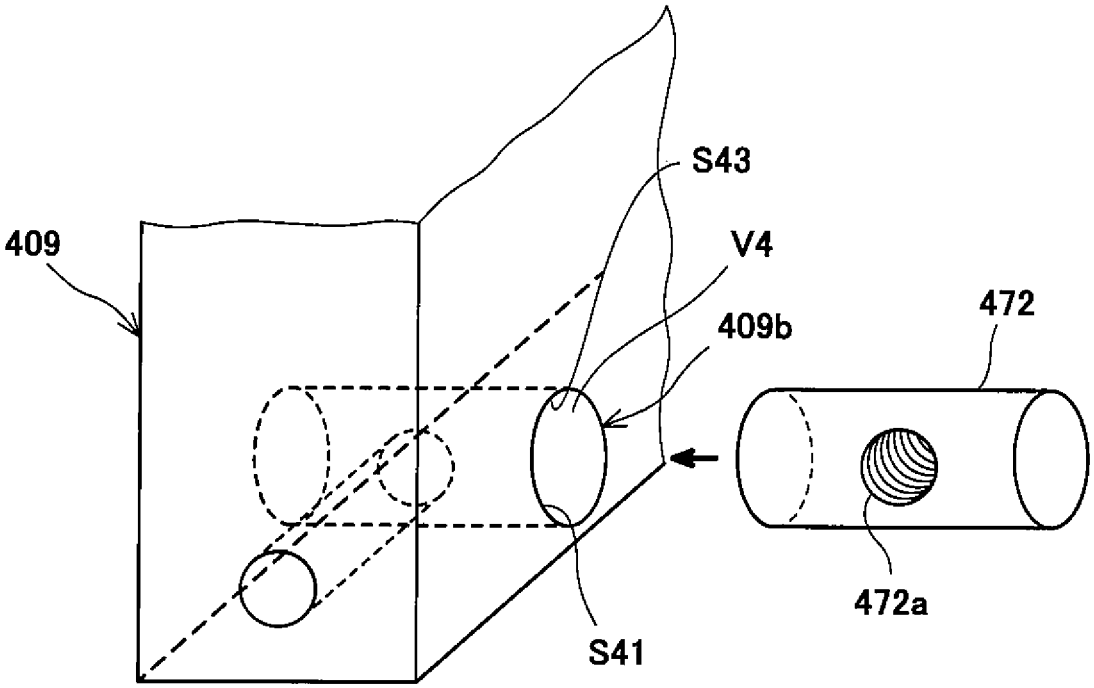
FIG. 12 is a diagram showing the single link type traction device of the railcar bogie according to Embodiment 4 and corresponding to FIG. 4.

FIG. 11 is a diagram showing the single link type traction device 400 of the railcar bogie according to the present embodiment and corresponding to FIG. 2. FIG. 12 is a diagram showing the single link type traction device 400 of the railcar bogie according to the present embodiment and corresponding to FIG. 4. As shown in FIGS. 11 and 12, the receiving seat 409 includes a circular hole 409*b* penetrating the receiving seat 409 in the car width direction. Specifically, a substantially cylindrical end mill is moved in the car width direction while being rotated around an axis extending in the car width direction. With this, the circular hole 409*b* penetrating the receiving seat 409 in the car width direction is formed. A nut accommodating space V4 is an internal space of the circular hole 409*b*. Therefore, the nut accommodating space V4 is formed by a circular-arc surface and is a cylindrical space.

The columnar nut 472 is accommodated in the nut accommodating space V4 from one side in the car width direction. The nut 472 includes a screw hole 472*a* including an inner peripheral surface having an internal thread threadedly engaged with an external thread of the bolt 71. Further, since the nut 472 has a columnar shape, a fastening surface 472*b* of the nut 472 has the same circular-arc shape as a first surface S41 forming the nut accommodating space V4. The nut 472 is accommodated in the nut accommodating space V4 such that a shortest distance between a third surface S43 of the receiving seat 409 forming the nut accommodating space V4 and the axis J1 of the bolt 71 is smaller than a maximum radius of the nut 472 when viewed from a direction along the axis J1.

Embodiment 4 described as above can obtain the same effects as Embodiment 1. Further, in Embodiment 4, the opposing region A, facing the nut 472, of the first surface S41 forming the nut accommodating space V4 has the same circular-arc shape as the fastening surface 472*b* of the nut 472. Therefore, when fastening the bolt 71 and the nut 72, the nut 72 can be brought into surface contact with the first surface S41 without using the spacer 11. Thus, the number of parts can be reduced.

The shortest distance between the third surface S43 of the receiving seat 409 and the axis J1 of the bolt 71 is smaller than the maximum radius of the nut 472. Therefore, even when the nut 472 rotates around the axis J1, the third surface S43 of the receiving seat 409 exists as an obstruction wall on a rotation trajectory of the nut 472, the rotation trajectory having a turning radius equal to the maximum radius. On this account, when fastening the bolt 71 and the nut 472, the nut 472 contacts the third surface S43 of the receiving seat 409, and thus, the nut 472 can be prevented from rotating together with the bolt 71.

The nut accommodating space V4 is an internal space of the circular hole 409*b* and is provided at the receiving seat 409 as a cylindrical space. The circular hole 409*b* is formed in such a manner that a substantially cylindrical end mill is moved in the car width direction while being rotated. Therefore, unlike a case where a polygonal hole is formed on a receiving seat, and an internal space of the polygonal hole is used as a nut accommodating space, the nut accommodating space V4 can be easily formed on the receiving seat 409.

Embodiment 5

A single link type traction device 500 of a railcar bogie according to Embodiment 5 is obtained by partially modifying the receiving seat 9 and the spacer 11 according to Embodiment 1. Hereinafter, differences between a receiving seat 509 and a spacer 511 according to Embodiment 5 and the receiving seat 9 and the spacer 11 according to Embodiment 1 will be mainly explained.

Figure 13:
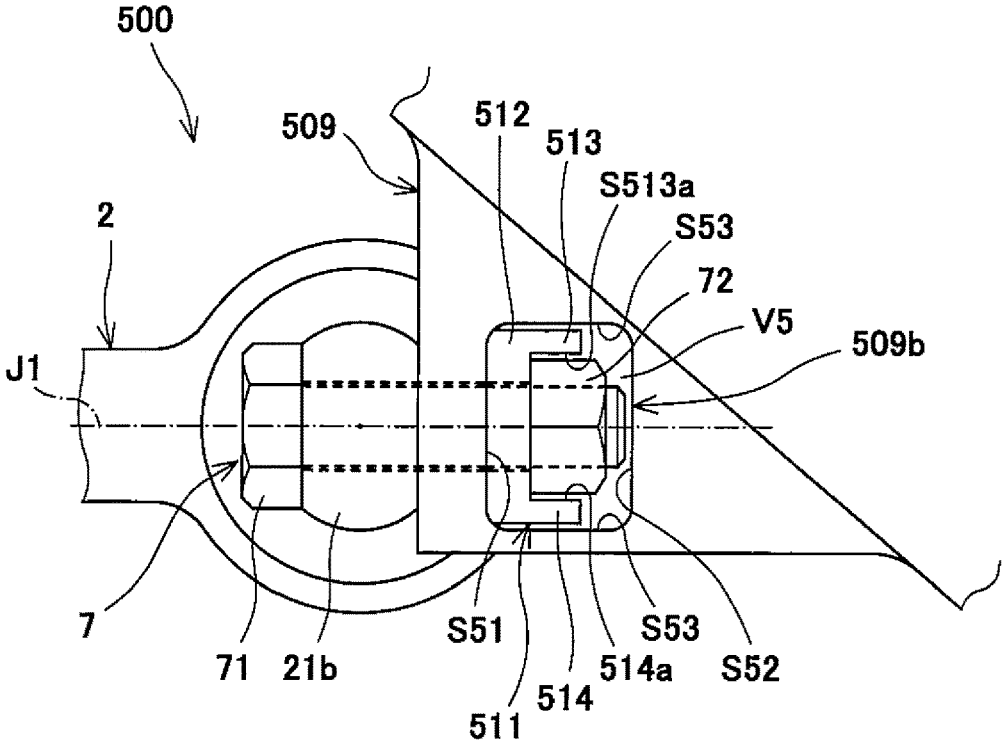
FIG. 13 is a diagram showing the single link type traction device of the railcar bogie according to Embodiment 5 and corresponding to FIG. 2.
Figure 14:
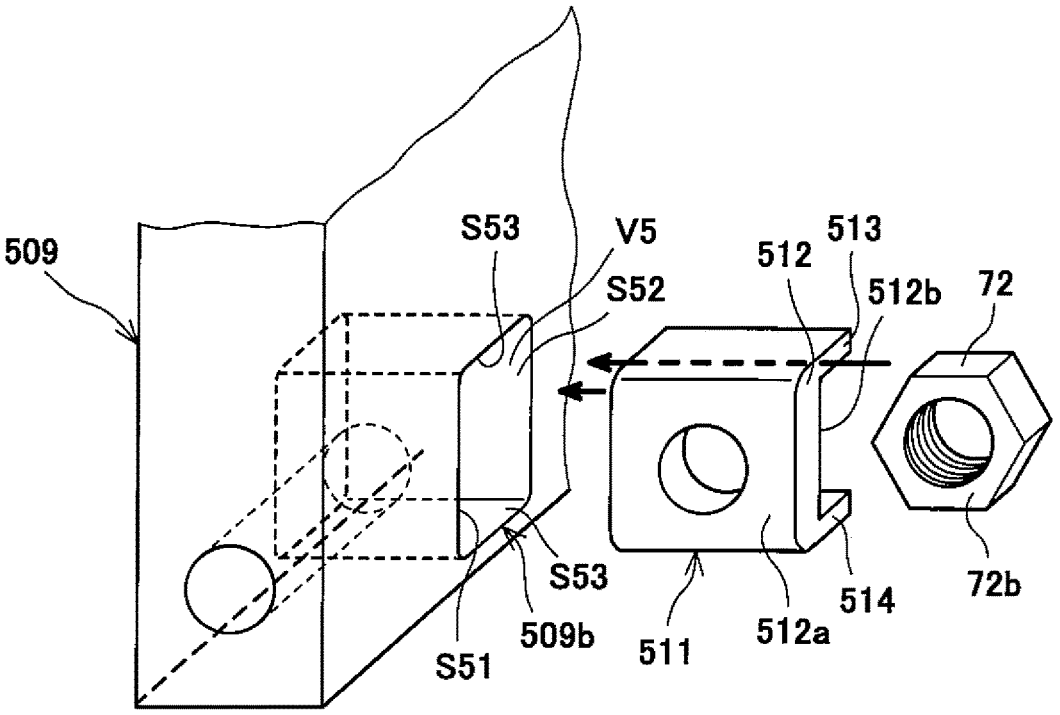
FIG. 14 is a diagram showing the single link type traction device of the railcar bogie according to Embodiment 5 and corresponding to FIG. 4.

FIG. 13 is a diagram showing the single link type traction device 500 of the railcar bogie according to Embodiment 5 and corresponding to FIG. 2. FIG. 14 is a diagram showing the single link type traction device 500 of the railcar bogie according to Embodiment 5 and corresponding to FIG. 5. As shown in FIGS. 13 and 14, the receiving seat 509 includes a polygonal hole 509*b* penetrating the receiving seat 509 in the car width direction. A nut accommodating space V5 is an internal space of the polygonal hole 509*b*. The nut accommodating space V5 is formed by: first and second surfaces S51 and S52 opposed to the nut 72 in a direction along the axis J1 of the bolt 71; and a third surface S53 opposed to the nut 72 in a direction perpendicular to the axis J1 of the bolt 71.

The first surface S51 includes: a flat surface portion parallel to the fastening surface 72*b* of the nut 72 when viewed from the car width direction; and circular-arc surface portions located at both respective upper and lower sides of the flat surface portion. Further, the nut 72 is accommodated in the nut accommodating space V5 such that a shortest distance between the third surface S53 and the axis J1 is larger than the maximum radius R of the nut 72.

In addition to the nut 72, the spacer 511 is accommodated in the nut accommodating space V5. The spacer 511 is a concave member. The spacer 511 includes a sandwiched portion 512 and extending portions 513 and 514. The sandwiched portion 512 is sandwiched between the first surface S51 and the fastening surface 72*b* of the nut 72. The extending portions 513 and 514 extend from both respective upward/downward direction ends of the sandwiched portion 512 toward the second surface S52.

An upward/downward direction size of the sandwiched portion 512 is larger than a maximum diameter of the nut 72. A surface 512*a*, facing the first surface S51, of the sandwiched portion 512 is parallel to the first surface S51 when viewed from the car width direction. Further, the surface 512*a*, facing the first surface S51, of the sandwiched portion 512 is larger in area than the fastening surface 72*b* of the nut 72. A surface 512*b*, facing the fastening surface 72*b*, of the sandwiched portion 512 has the same planar shape as the fastening surface 72*b*.

Further, each of the extending portions 513 and 514 is opposed to the nut 72 so as to be spaced apart from the nut 72 in the upward/downward direction. To be specific, each of a lower surface 513*a* of the extending portion 513 and an upper surface 514*a* of the extending portion 514 is opposed to the nut 72 in a direction perpendicular to the axis J1. Hereinafter, the lower surface 513*a* of the extending portion 513 and the upper surface 514*a* of the extending portion 514 are referred to as nut opposing surfaces. A shortest distance between the axis J1 of the bolt 71 and the nut opposing surface 513*a* or 514*a* is set to be smaller than the maximum radius R of the nut 72 when viewed from the direction along the axis J1.

Embodiment 5 described as above can obtain the same effects as Embodiment 1. Further, the nut 72 is accommodated in the nut accommodating space V5 such that the shortest distance between the third surface S53 and the axis J1 is larger than the maximum radius R of the nut 72.

However, in the spacer 511 of the present embodiment, the extending portions 513 and 514 extending from both respective upward/downward direction ends of the sandwiched portion 512 include the nut opposing surfaces 513*a* and 514*a*, respectively. Then, the shortest distance between the axis J1 of the bolt 71 and the nut opposing surface 513*a* or 514*a* is set to be smaller than the maximum radius R of the nut 72 when viewed from the direction along the axis J1. With this, even if the nut 72 rotates around the axis J1 when fastening the bolt 71 and the nut 72, the nut opposing surfaces 513*a* and 514*a* of the spacer 511 exist as obstruction walls on a rotation trajectory of the nut 72, the rotation trajectory having a turning radius equal to the maximum radius R. Therefore, when fastening the bolt 71 and the nut 72, the nut 72 contacts the nut opposing surfaces 513*a* and 514*a*, and thus, the nut 72 can be prevented from rotating together with the bolt 71.

In Embodiment 1, when fastening the bolt 71 and the nut 72, the nut 72 contacts the third surface S3 of the receiving seat 9 to be prevented from rotating together with the bolt 71. In addition, an upward/downward direction size of the surface 11*b* of the spacer 11 is substantially equal to an upward/downward direction size of the fastening surface 72*b* of the nut 72. To prevent a case where the spacer 11 and the receiving seat 9 plastically deform by axial force generated when the bolt 71 and the nut 72 are fastened to each other through the spacer 11, strength design is performed such that surface pressure acting on the surface 11*b* of the spacer 11 and the first surface S1 of the receiving seat 9 is not more than each of a surface pressure limit of a material of the spacer 11 and a surface pressure limit of a material of the receiving seat 9. When calculating the surface pressure acting on the surface 11*b* of the spacer 11 and the first surface S1 of the receiving seat 9, a contact area between the spacer 11 and the receiving seat 9 (i.e., an area of a seat surface of the spacer 11) is used. A washer (spacer) based on Industrial Standard (JIS, etc.) is larger in size than a fastening surface of a nut. In the Industrial Standard, the area of the seat surface of the washer is also defined.

However, as described above, the upward/downward direction size of the spacer 11 is equal to that of the fastening surface 72*b* of the nut 72, and there is a possibility that the area of the seat surface of the spacer 11 is smaller than the area of the seat surface of the washer defined in the Industrial Standard. Therefore, when calculating the surface pressure acting on the spacer 11 and the receiving seat 9, the area of the seat surface of the washer defined in the Industrial Standard cannot be used.

In the present embodiment, the nut 72 contacts the nut opposing surfaces 513*a* and 514*a* of the spacer 511 to be prevented from rotating together with the bolt 71, and an upward/downward direction size of the surface 512*a* of the spacer 511 is larger than the upward/downward direction size of the fastening surface 72*b* of the nut 72. With this, the contact area between the spacer 511 and the receiving seat 509 (i.e., an area of a seat surface of the spacer 511) can be set to be not less than the area of the seat surface of the washer defined in the Industrial Standard. Therefore, when performing the strength design of the spacer 511 and the receiving seat 509, the surface pressure acting on each of the spacer 511 and the receiving seat 509 is calculated by utilizing the area of the seat surface of the washer defined in the Industrial Standard, and the surface pressure is confirmed to be not more than each of the surface pressure limit of the material of the spacer 511 and the surface pressure limit of the material of the receiving seat 509. With this, the strength of the spacer 511 and the receiving seat 509 can be regarded as adequate. On this account, in the present embodiment, regarding the strength design of the spacer 511 and the receiving seat 509 when fastening the bolt 71 and the nut 72, the same design as a case where the washer based on the Industrial Standard is used for fastening a bolt and a nut can be realized.

Embodiment 6

A traction device 600 of a bogie 605 according to Embodiment 6 is obtained by partially modifying the traction device 500 according to Embodiment 5. Hereinafter, differences between the traction device 600 according to Embodiment 6 and the traction device 500 according to Embodiment 5 will be mainly explained.

Figure 15:
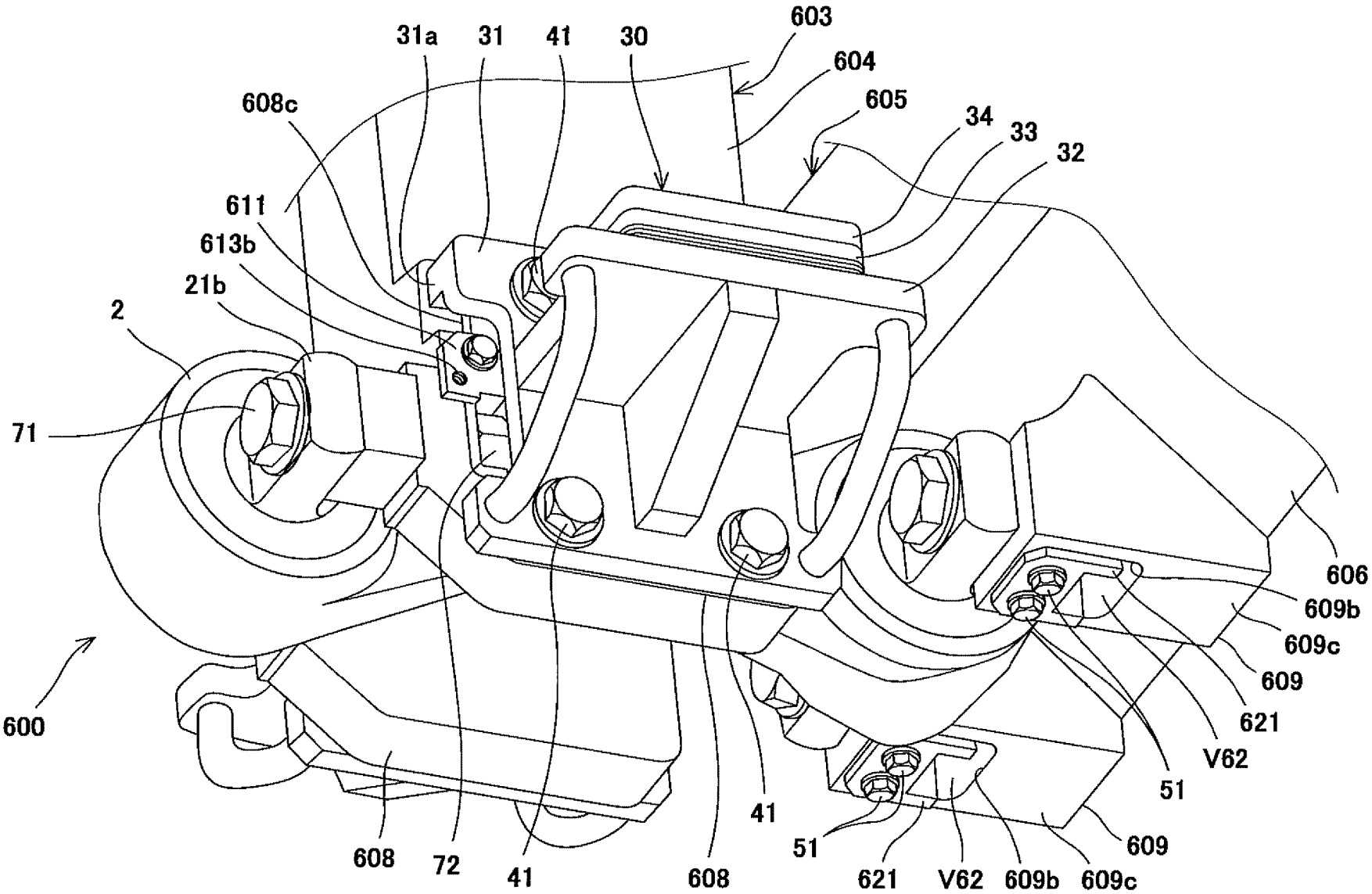
FIG. 15 is a perspective view showing the single link type traction device of the railcar bogie according to Embodiment 6 when viewed from an obliquely lower side.
Figure 16:
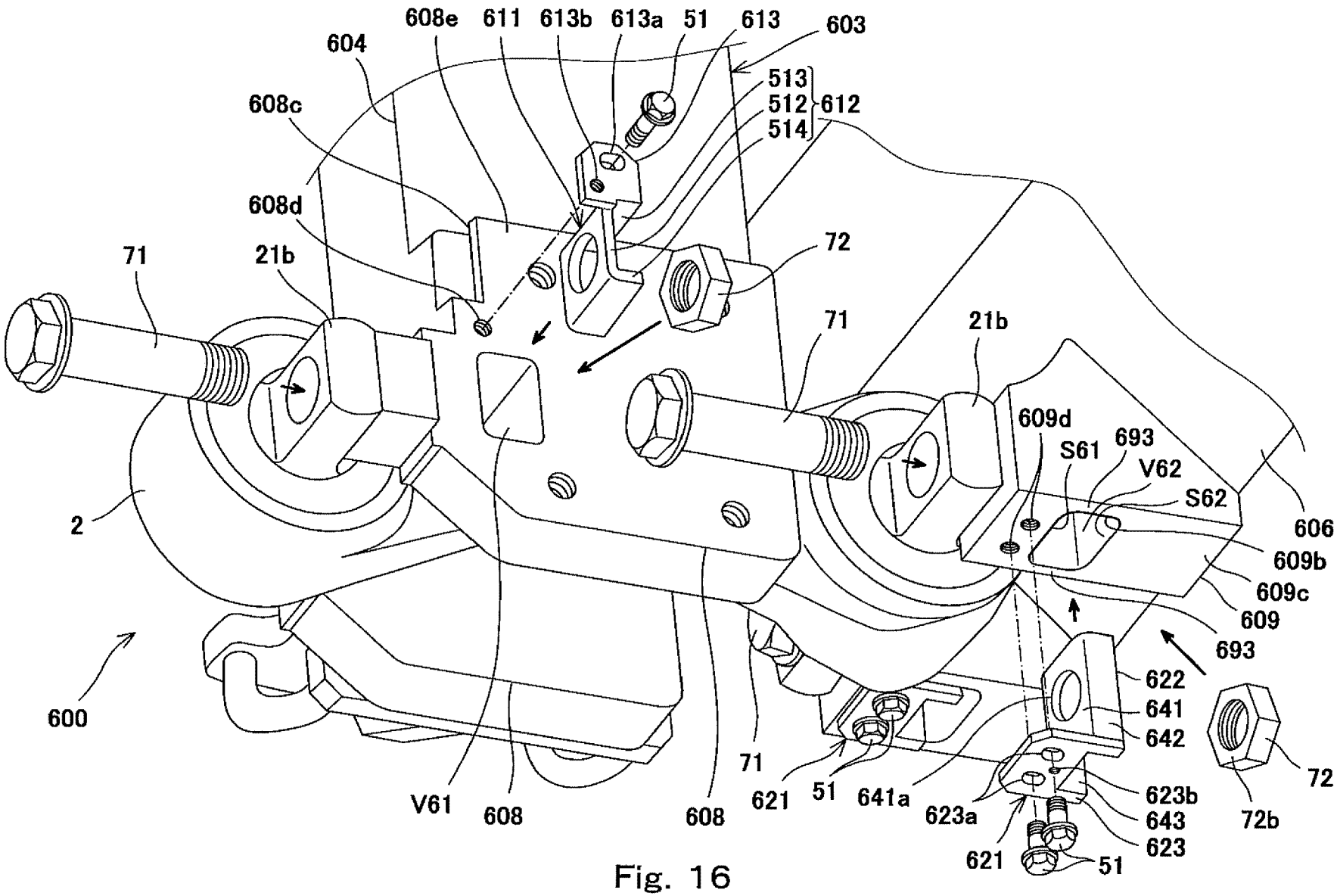
FIG. 16 is a perspective view showing a disassembled state of a part of a fixing structure for fixing a link member and the receiving seat in the traction device shown in FIG. 15.

FIG. 15 is a perspective view showing the traction device 600 according to Embodiment 6 when viewed from an obliquely lower side. FIG. 16 is a perspective view showing a disassembled state of a fixing structure for fixing the link member 2 and receiving seats 608 and 609 in the traction device 600 shown in FIG. 15. As shown in FIG. 15, a restricting member 30 is fixed to a center pin 604 by a plurality of bolts 41. The restricting member 30 is a member configured to restrict abnormal rising of a carbody 603 by expansion of an air spring (not shown). The restricting member 30 includes: a fixed portion 31 fixed to the receiving seat 608 of the center pin 604; and a contacting portion 32 projecting from the fixed portion 31 outward in the car width direction.

The fixed portion 31 has a substantially flat plate shape and includes a lock portion 31*a* locked to a groove portion 608*c* from an upper side, the groove portion 608*c* being formed by depressing an upper surface of the receiving seat 608 downward. Since the lock portion 31*a* is locked to the groove portion 608*c*, the restricting member 30 is temporarily fixed to the center pin 604 before being fixed by the bolts 41. The contacting portion 32 has a substantially flat plate shape, and a resin member 34 is provided on an upper surface of the contacting portion 32 through a metal plate 33. When the air spring expands by a predetermined amount or more, the resin member 34 contacts a bogie frame 606 to restrict the abnormal rising of the carbody 603.

As shown in FIGS. 15 and 16, spacers 611 and 621 are respectively fixed to the receiving seats 608 and 609 by second fastening members constituted by spacer fixing bolts 51. The spacer 611 inserted into a nut accommodating space V61 of the receiving seat 608 and the spacer 621 inserted into a nut accommodating space V62 of the receiving seat 609 are different in shape and insertion direction from each other.

The receiving seat 608 includes a screw hole 608*d* having an internal thread threadedly engaged with an external thread of the spacer fixing bolt 51, and the receiving seat 609 includes screw holes 609*d* each having an internal thread threadedly engaged with the external thread of the spacer fixing bolt 51. The screw hole 608*d* is provided on a car width direction outer side surface 608*e* of the receiving seat 608 so as to be located above the nut accommodating space V61 and extends in the car width direction. The screw hole 608*d* is provided under the groove portion 608*c*. Each of the screw holes 609*d* is provided on a lower surface 609*c* of the receiving seat 609 so as to be located at a side where the core rod 21*b* exists when viewed from the nut accommodating space V62. Each of the screw holes 609*d* extends in the upward/downward direction. In the receiving seat 609, coupling portions 693 are wall portions located at both respective car width direction sides of the nut 72 and forming the nut accommodating space V62.

The spacer 611 is inserted into the nut accommodating space V61 of the receiving seat 608 from an outer side in the car width direction. The spacer 611 includes: a spacer main body portion 612 accommodated in the nut accommodating space V61; and a flange portion 613 projecting from the spacer main body portion 612 to an outside of the nut accommodating space V61. The spacer main body portion 612 is constituted by: the sandwiched portion 512; and the pair of upper and lower extending portions 513 and 514.

The flange portion 613 projects upward from a car width direction outer end portion of the spacer main body portion 612 and extends along the car width direction outer side surface 608*e* of the receiving seat 608. The flange portion 613 includes: a second through hole 613*a* into which the spacer fixing bolt 51 is inserted; and a screw hole 613*b* provided under the second through hole 613*a*. The second through hole 613*a* is a drilled hole, in other words, an elongated hole having a longitudinal-direction diameter larger than a diameter of the spacer fixing bolt 51. After the core rod 21*b* and the receiving seat 608 are fixed to each other by the bolt 71, the spacer 611, and the nut 72, the spacer 611 is fixed to the receiving seat 608 by the spacer fixing bolt 51 through the second through hole 613*a*.

If paint or the like is applied to the surface of the receiving seat 608 and/or the surface of the flange portion 613, the flange portion 613 may adhere to the side surface 608*e* of the receiving seat 608. Therefore, even if the spacer fixing bolt 51 is detached, the spacer 611 is hardly detached from the receiving seat 608. In this case, to facilitate detaching of the spacer 611, the screw hole 613*b* is used. Specifically, in a state where a tip end portion of a screw threadedly engaged with the screw hole 613*b* is pressed against the side surface 608*e* of the receiving seat 608, the screw is rotated. With this, the flange portion 613 is moved in a direction away from the receiving seat 608.

The nut accommodating space V62 is an internal space of a polygonal hole 609*b* extending in the upward/downward direction and is concavely provided on the lower surface 609*c* of the receiving seat 609. The spacer 621 is inserted into the nut accommodating space V62 from a lower side. The spacer 621 includes: a spacer main body portion 622 accommodated in the nut accommodating space V62; and a flange portion 623 projecting from the spacer main body portion 622 to an outside of the nut accommodating space V62.

The spacer main body portion 622 includes: a sandwiched portion 641 sandwiched between a first surface S61 of the receiving seat 609 and the fastening surface 72*b* of the nut 72; and a pair of left and right extending portions 642 and 643 extending from both respective leftward/rightward direction ends of the sandwiched portion 641 toward a second surface S62 of the receiving seat 609. The sandwiched portion 641 includes a first through hole 641*a* into which the bolt 71 is inserted.

The flange portion 623 projects from a lower end portion of the spacer main body portion 622 toward the core rod 21*b* and extends along the lower surface 609*c* of the receiving seat 609. The flange portion 623 includes: two second through holes 623*a* into which the respective spacer fixing bolts 51 are inserted; and a screw hole 623*b* provided between the two second through hole 623*a*. Each of the second through holes 623*a* is a drilled hole, in other words, an elongated hole having a longitudinal-direction diameter larger than the diameter of the spacer fixing bolt 51. After the core rod 21*b* and the receiving seat 609 are fixed to each other by the bolt 71, the spacer 621, and the nut 72, the flange portion 623 of the spacer 621 is fixed to the receiving seat 609 through the second through holes 623*a*. The screw hole 623*b* has the same function as the screw hole 613*b* and is used according to need when detaching the spacer 621 from the receiving seat 609. Other than the above, Embodiment 6 is the same in configuration as Embodiment 5.

Embodiment 6 described as above can obtain the same effects as Embodiment 5. Further, in Embodiment 6, the spacers 611 and 621 are respectively fixed to the receiving seats 608 and 609 by the spacer fixing bolts 51. Therefore, before and after the bolts 71 and the nuts 72 are detached at the time of maintenance or the like, the spacers 611 and 621 can be kept at the same positions, and therefore, can be prevented from falling and being lost.

On the receiving seat 608, the screw hole 608*d* is located under the groove portion 608*c* formed on the upper surface of the receiving seat 608 and extends in the car width direction. With this, the spacer fixing bolt 51 inserted into the screw hole 608*d* can fix the spacer 611 to the receiving seat 608 while being prevented from interfering with the lock portion 31*a* of the restricting member 30, the lock portion 31*a* being locked to the groove portion 608*c*.

Further, the nut accommodating space V62 is concavely provided on the lower surface 609*c* of the receiving seat 609, and the coupling portions 693 are the wall portions located at both respective car width direction sides of the nut 72 and forming the nut accommodating space V62. With this, even when a load in the car longitudinal direction acts on the receiving seat 609, the generation of the high stress can be suppressed at a portion of the receiving seat 609 where a section perpendicular to the car longitudinal direction changes, unlike a case where the nut accommodating space penetrates the receiving seat in the car width direction. Thus, the strength of the entire receiving seat 609 can be secured. Since the load in the car longitudinal direction, such as the driving force of the bogie 605 and the braking force, is transmitted from the receiving seat 609 of the bogie frame 606 of the bogie 605 through the link member 2 and the receiving seat 608 to the carbody 603, the load acting on the receiving seat 609 is high. Therefore, to secure the strength of the receiving seat 609 of the bogie frame 606, the configuration of the present embodiment is effective.

Embodiment 7

A traction device 700 of a bogie according to Embodiment 7 is obtained by partially modifying the receiving seat 309 according to Embodiment 3. Hereinafter, differences between a receiving seat 709 according to Embodiment 7 and the receiving seat 309 according to Embodiment 3 will be mainly explained.

Figure 17:
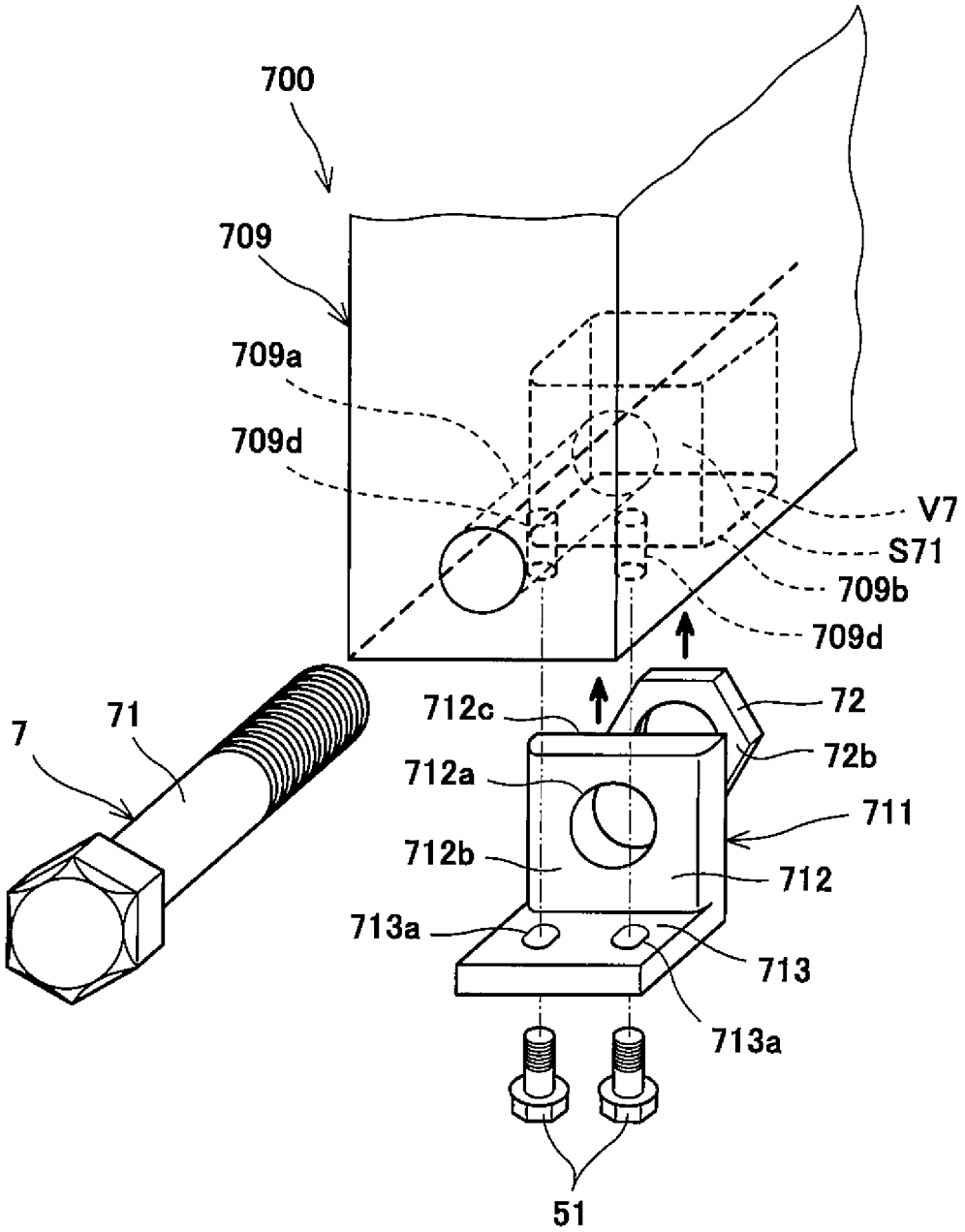
FIG. 17 is a diagram showing the single link type traction device of the railcar bogie according to Embodiment 7 and corresponding to FIG. 9.

FIG. 17 is a diagram showing the traction device 700 according to Embodiment 7 and corresponding to FIG. 9. As shown in FIG. 17, a spacer 711 is inserted into a nut accommodating space V7 of the receiving seat 709 together with the nut 72. The spacer 711 is fixed to the receiving seat 709 by second fastening members constituted by the spacer fixing bolts 51. The receiving seat 709 includes screw holes 709*d* each having an internal thread threadedly engaged with an external thread of the spacer fixing bolt 51. The screw holes 709*d* are formed on a lower surface 709*c* of the receiving seat 709 so as to be located at a side where the core rod 21*b* (see FIG. 1) exists when viewed from the nut accommodating space V7. The screw holes 709*d* are provided at both respective car width direction sides of a through hole 709*a*.

The spacer 711 includes: a spacer main body portion 712 accommodated in the nut accommodating space V7 and having a substantially flat plate shape; and a flange portion 713 projecting from the spacer main body portion 712 to an outside of the nut accommodating space V7. The spacer main body portion 712 includes a first through hole 712*a* into which the bolt 71 is inserted. The spacer main body portion 712 is sandwiched between the receiving seat 709 and the nut 72 in the nut accommodating space V7. A surface 712*b*, facing the receiving seat 709, of the spacer main body portion 712 includes a flat surface portion and circular-arc surface portions located at both respective left and right sides of the flat surface portion. A surface 712*c*, facing the nut 72, of the spacer main body portion 712 has the same planar shape as the fastening surface 72*b*.

The flange portion 713 projects from a lower end portion of the spacer main body portion 712 toward the core rod 21*b* and extends along the lower surface 709*c* of the receiving seat 709. The flange portion 713 includes a pair of second through holes 713*a* into which the respective spacer fixing bolts 51 are inserted. The second through holes 713*a* are drilled holes, in other words, elongated holes each having a longitudinal-direction diameter larger than the diameter of the spacer fixing bolt 51. After the core rod 21*b* and the receiving seat 709 are fixed to each other by the bolt 71, the spacer 711, and the nut 72, the spacer 711 is fixed to the receiving seat 709 through the second through holes 713*a*. Other than the above, Embodiment 7 is the same in configuration as Embodiment 3.

Embodiment 7 described as above can obtain the same effects as Embodiment 3. Further, the spacer 711 is fixed to the receiving seat 709 by the spacer fixing bolts 51. Therefore, before and after the bolt 71 and the nut 72 are detached at the time of maintenance or the like, the spacer 711 can be kept at the same position, and therefore, can be prevented from falling and being lost.

The present invention is not limited to the above embodiments, and modifications, additions, and eliminations may be made within the scope of the present invention. In the above embodiments, the receiving seats (8, 608, 9, 609) of the center pin (4, 604) and the bogie frame (6, 606) are fixed to the core rod 21*b* of the link member 2 by the first fastening members 7 including the bolts 71 and the nuts 72. However, the present invention is not limited to this. Any one of the receiving seat (8, 608) of the center pin (4, 604) and the receiving seat (9, 609) of the bogie frame (6, 606) may be fixed to the core rod 21*b* of the link member 2 by the first fastening member 7. Further, in the above embodiments, the nut (72, 472) is a hexagon nut or a columnar nut. However, the present invention is not limited to this. The nut (72, 472) may be, for example, a square nut having a square outer shape.

REFERENCE SIGNS LIST

1, 200, 300, 400, 500, 600, 700 single link type traction device
2 link member
3, 603 carbody
4, 604 center pin (fixation target object)
5, 605 railcar bogie
6, 606 bogie frame (fixation target object)
7 first fastening member
8, 608 receiving seat
9, 209, 309, 409, 509, 609, 709 receiving seat
9*a*, 709*a* through hole
309*c*, 609*c* lower surface
609*d*, 709*d* screw hole
10 railcar
11, 511, 611, 621, 711 spacer
11*a*, 712*a* first through hole
51 spacer fixing bolt (second fastening member)
71 bolt
72, 472 nut
72*b*, 472*b* fastening surface
90 base portion
91 first projecting portion
92 second projecting portion
93, 393, 693 coupling portion
513*a*, 514*a* nut opposing surface
608*f*, 709*f* screw hole
612, 622, 712 spacer main body portion
613, 623, 713 flange portion
613*a*, 623*a*, 713*a* second through hole
J1 axis
S1, S21, S31, S41, S51, S61 first surface
S2, S22, S32, S52, S62 second surface
S3, S32, S33, S43 third surface
V1, V2, V3, V4, V5, V61, V62, V7 nut accommodating space

The invention claimed is:

1. A railcar bogie comprising:
a bogie frame; and
a single link type traction device coupling the bogie frame and a carbody and transmitting force to the carbody, the force acting on the bogie frame, wherein:
the single link type traction device includes
a single link member coupling a center pin of the carbody and the bogie frame and extending in a car longitudinal direction,
a receiving seat provided at a fixation target object constituted by the center pin or the bogie frame, the link member being fixed to the receiving seat, and
a first fastening member including a bolt and a nut and fixing an end portion of the link member to the receiving seat, the bolt being inserted into the end portion of the link member and the receiving seat from one side in the car longitudinal direction, the nut being threadedly engaged with the bolt from the other side in the car longitudinal direction; and
the receiving seat includes:
a through hole into which the bolt is inserted;
a nut accommodating space communicating with the through hole and accommodating the nut;
a base portion joined to the fixation target object;
a first projecting portion including a first surface and the through hole and projecting from the base portion, the first surface being located at the one side of the nut in the car longitudinal direction and forming the nut accommodating space;
a second projecting portion including a second surface and projecting from the base portion, the second surface being located at the other side of the nut in the car longitudinal direction and forming the nut accommodating space; and
a coupling portion coupling the first projecting portion and the second projecting portion at a side where a projecting end of the first projecting portion exists when viewed from at least an axis of the bolt.

2. The railcar bogie according to claim 1, wherein:
the nut accommodating space is concavely provided on a lower surface of the receiving seat; and
the coupling portion includes wall portions located at both respective car width direction sides of the nut and forming the nut accommodating space.

3. The railcar bogie according to claim 1, wherein:
the receiving seat includes a third surface opposed to the nut in a direction perpendicular to an axis of the bolt and forming the nut accommodating space; and
a shortest distance between the third surface and the axis is smaller than a maximum radius of the nut.

4. The railcar bogie according to claim 1, wherein:
the single link type traction device further includes a spacer sandwiched between the first surface and a fastening surface of the nut and including a first through hole into which the bolt is inserted;

an opposed region, facing the fastening surface, of the first surface is different in shape from the fastening surface;

a surface, facing the first surface, of the spacer is the same shape as the opposed region of the first surface; and a surface, facing the fastening surface, of the spacer is the same shape as the fastening surface.

5. The railcar bogie according to claim 1, wherein:

the single link type traction device further includes a spacer sandwiched between the first surface and a fastening surface of the nut and including a first through hole into which the bolt is inserted;

the spacer includes a nut opposing surface opposed to the nut in a direction perpendicular to an axis of the bolt; and a shortest distance between the nut opposing surface and the axis is smaller than a maximum radius of the nut.

6. The railcar bogie according to claim 4, wherein:

the single link type traction device further includes a second fastening member constituted by a spacer fixing bolt fixing the spacer to the receiving seat;

the spacer includes a spacer main body portion accommodated in the nut accommodating space and a flange portion projecting from the spacer main body portion to an outside of the nut accommodating space and extending along an outer surface of the receiving seat;

the flange portion includes a second through hole into which the spacer fixing bolt is inserted; and the receiving seat includes a screw hole having an internal thread threadedly engaged with an external thread of the spacer fixing bolt.

7. A railcar comprising the railcar bogie according to claim 1.

* * * * *